US005844589A

United States Patent [19]

Orlicki et al.

[11] Patent Number: 5,844,589

[45] Date of Patent: Dec. 1, 1998

[54] CAPACITIVE FOCUS GAUGE FOR LED PRINTER

[75] Inventors: David Mark Orlicki, Rochester; Karen Lynn Herczeg, Webster, both of N.Y.

[73] Assignee: Eastman Kodak Company, Rochester, N.Y.

[21] Appl. No.: 630,192

[22] Filed: Apr. 10, 1996

[51] Int. Cl.[6] ..... B41J 2/39; B41J 2/395; B41J 2/47; B41J 2/385

[52] U.S. Cl. ..... 347/141; 347/242; 347/160; 399/26

[58] Field of Search ..... 399/26; 347/129, 347/141, 160, 257, 242, 147, 149, 152, 153; 355/296, 298; 359/17; 101/287, 150

[56] References Cited

U.S. PATENT DOCUMENTS 3,748,577 7/1973 Jones, Jr. ..... 324/671
4,669,070 5/1987 Bell ..... 369/44.18
4,698,647 10/1987 Gerlach ..... 347/257
5,136,262 8/1992 Spencer ..... 331/135
5,166,626 11/1992 Hester et al. ..... 324/690

*Primary Examiner*—Benjamin R. Fuller
*Assistant Examiner*—Raquel Yvette Gordon
*Attorney, Agent, or Firm*—Walter S. Stevens

[57] ABSTRACT

According to a feature of the present invention, an imaging apparatus has a support with a cylindrical inner surface for receiving a recording media about an axis of the support. A rotor forms a gap with the inner surface such that the gap varies as the rotor rotates and as an inverse function of the concentricity of the support and the rotor. An electrode is carried at the portion of the rotor forming the gap with the inner surface such that a capacitance between the electrode and the inner surface varies as the rotor rotates and as an inverse function of the concentricity of the support and the rotor. A detector, including a power source adapted to produce an electrical charge across the gap and an impedance, measures the change in the dimension of the gap as the rotor rotates so that the concentricity of the support and the rotor can be measured while the rotor is rotating.

10 Claims, 5 Drawing Sheets

FIG. 6
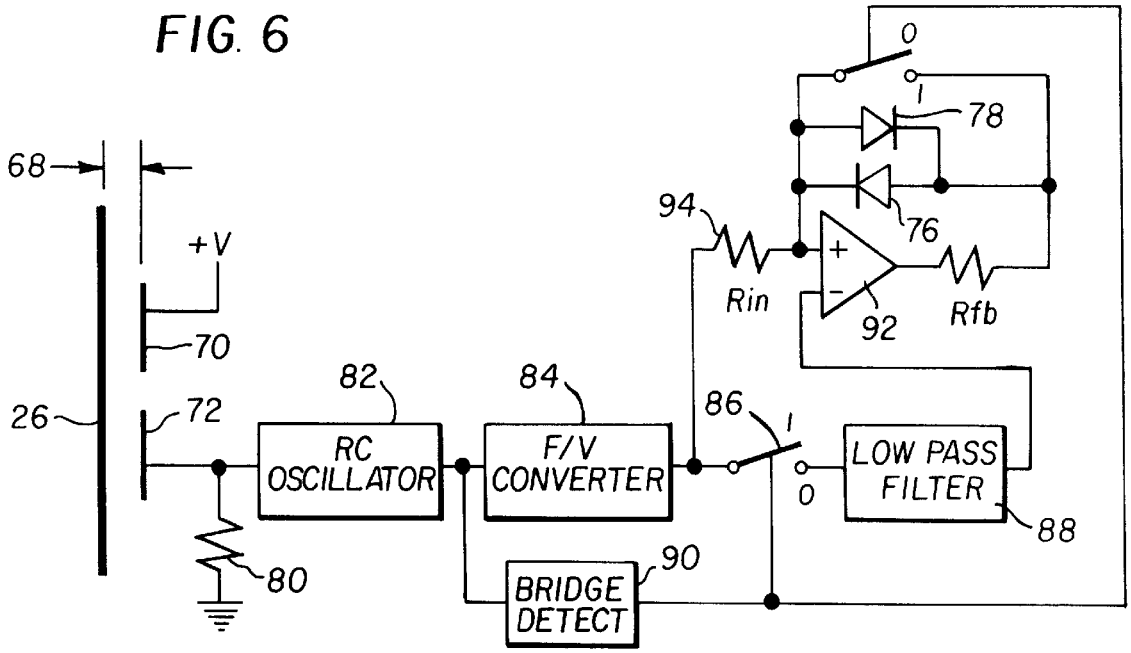
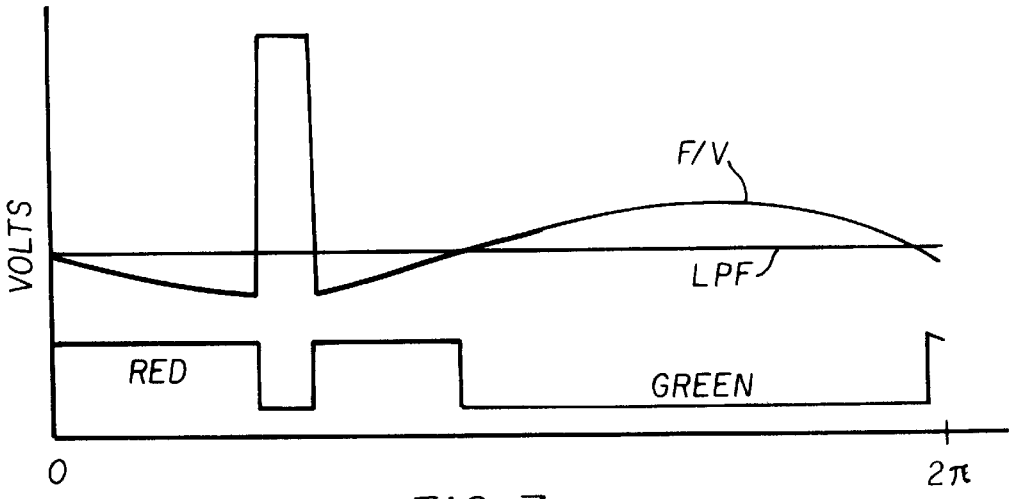
FIG. 7

CAPACITIVE FOCUS GAUGE FOR LED PRINTER

CROSS-REFERENCE TO RELATED APPLICATIONS

Reference is made to commonly assigned, co-pending U.S. patent application Ser. No. 08/123,838 entitled LEAD-SCREW COUPLER, filed in the names of Jadrich et al. on Sep. 20, 1993 and Ser. No. 08/371,241 entitled DIGITAL PRINTER WITH SUPPORT SHOE AND TRANSLATABLE MEDIA GUIDE MEMBER THEREIN filed in the name of M. Bridges on Jan. 11, 1995.

BACKGROUND OF THE INVENTION

1. Technical Field

This invention relates generally to the field of electronic digital imaging and, specifically, to such imaging systems that utilize a light source write head to record information by scanning photosensitive media.

2. Background Art

Electronic digital imaging, such as for example in copiers and/or printers, is accomplished by modulating the intensity of a light beam that forms a writing spot on photosensitive media as the beam moves relative to the photosensitive media. One type of electronic digital imager uses a modulated array of light emitting diodes (LED's) positioned on a write head assembly resident on a rotor which is simultaneously rotated about a fixed axis and linearly translated past stationary photosensitive recording media mounted on the inner surface of a cylindrical support to form a plurality of writing spots moving across the photosensitive material in a fast scan direction and in a slow scan direction, such as disclosed in commonly assigned, co-pending U.S. patent application Ser. No. 08/371,241, entitled DIGITAL PRINTER WITH SUPPORT SHOE AND TRANSLATABLE MEDIA GUIDE MEMBER THEREIN filed in the name of M. Bridges on Jan. 11, 1995. The disclosure of the Bridges patent application is hereby specifically incorporated herein by reference.

Imagers such as disclosed in the Bridges application must be focused onto the predicted media surface. The optics must remain focused under high rotational gravitational forces, and yet be easily re-focused in the field.

An important aspect of focus is the gauging of the concentricity of the rotor within the cylindrical support. Existing implementations of such systems are equipped with mounting hardware built into the end of the rotor opposite the printhead and to which a standard mechanical indicator, such as a feeler gauge, may be temporally attached. to align the rotor and the cylindrical support axes, the indicator is put in place and observed as the rotor is manually rotated. The alignment of the rotor and the cylindrical support is adjusted by either translating the rotor carriage base or the cylindrical support mounts. A problem with this approach is that the indicator hardware must be installed and removed for each adjustment, including the original fabrication and testing and field installation, as well as after maintenance of the rotor carriage. This is time consuming, and requires allowance in the machine design for permanent storage of a rather expensive and delicate indicator. A second problem is that alignment is measured and adjusted with the rotor in a quasi-static position relative to its normal use.

DISCLOSURE OF THE INVENTION

It is an object of the present invention to provide means integral to the rotor whereby the concentricity of rotor and cylindrical support can be measured while the rotor is spinning as in normal use.

It is another object of the present invention to provide a system for concentrically aligning the rotor and the cylindrical support without disassembly or additional gauge tooling.

It is still another object of the present invention to provide a gauge that can be integrally added to existing rotors.

According to a feature of the present invention, an imaging apparatus has a support with a cylindrical inner surface for receiving a recording media about an axis of the support. A rotor forms a gap with the inner surface such that the gap varies as the rotor rotates and as an inverse function of the concentricity of the support and the rotor. An electrode is carried at the portion of the rotor forming the gap with the inner surface such that a capacitance between the electrode and the inner surface varies as the rotor rotates and as an inverse function of the concentricity of the support and the rotor. A detector, including a power source adapted to produce an electrical charge across the gap and an impedance, measures the change in the dimension of the gap as the rotor rotates so that the concentricity of the support and the rotor can be measured while the rotor is rotating.

The invention, and its objects and advantages, will become more apparent in the below description of the preferred embodiments.

BRIEF DESCRIPTION OF THE DRAWINGS

In the detailed description of the preferred embodiments of the invention presented below, reference is made to the accompanying drawings, in which:

FIG. 6 is a block diagram of an alternative embodiment of a circuit for sensing the gap between the rotor and the cylindrical support of the rotary printing system of FIGS. 1–3;

FIG. 7 is a graph comparing the output of frequency-to-voltage converter to the LED output;

BEST MODE FOR CARRYING OUT THE INVENTION

The present description will be directed, in particular, to elements forming part of, or cooperating more directly with, apparatus in accordance with the present invention. It is to be understood that elements not specifically shown or described may take various forms well known to those skilled in the art.

Figure 1:
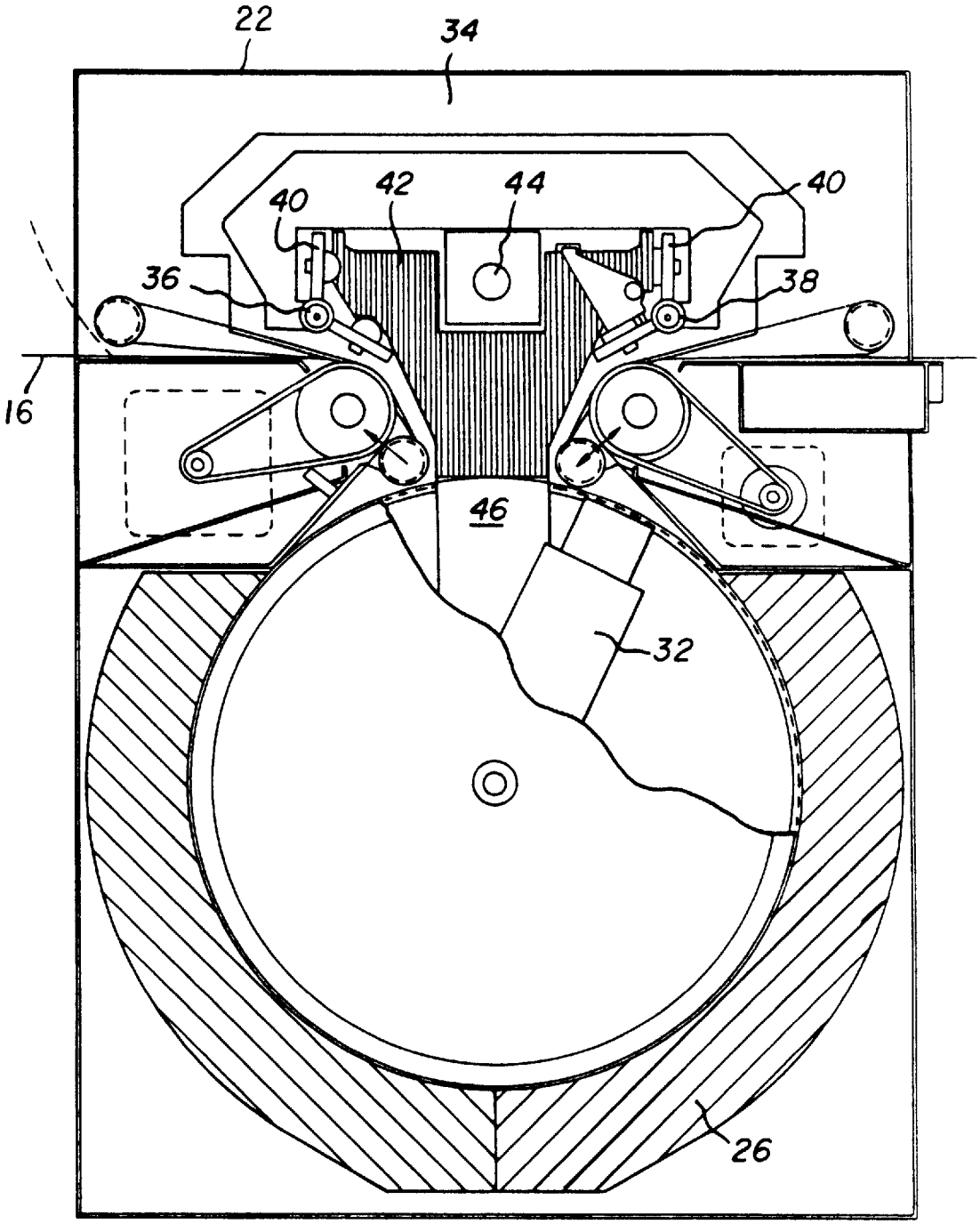
FIG. 1 a front view of a rotary printing system according to the prior art, and in which the present invention is useful.

FIG. 1 is a front illustration of a printer. A web of photographic light sensitive media 16 is fed to a write station 22 which is disclosed in detail in the above-mentioned U.S. patent application entitled DIGITAL PRINTER WITH SUPPORT SHOE AND TRANSLATABLE MEDIA GUIDE MEMBER THEREIN. The write station includes a cylindrical support 26. The arcuate inner surface of cylindrical support 26 is precisely bored so that an LED illumination means, not shown, mounted on a rotor 32 focuses on the emulsion side of media 16. A translator base assembly 34 is attached to framework to support guide rods 36 and 38.

Figure 2:
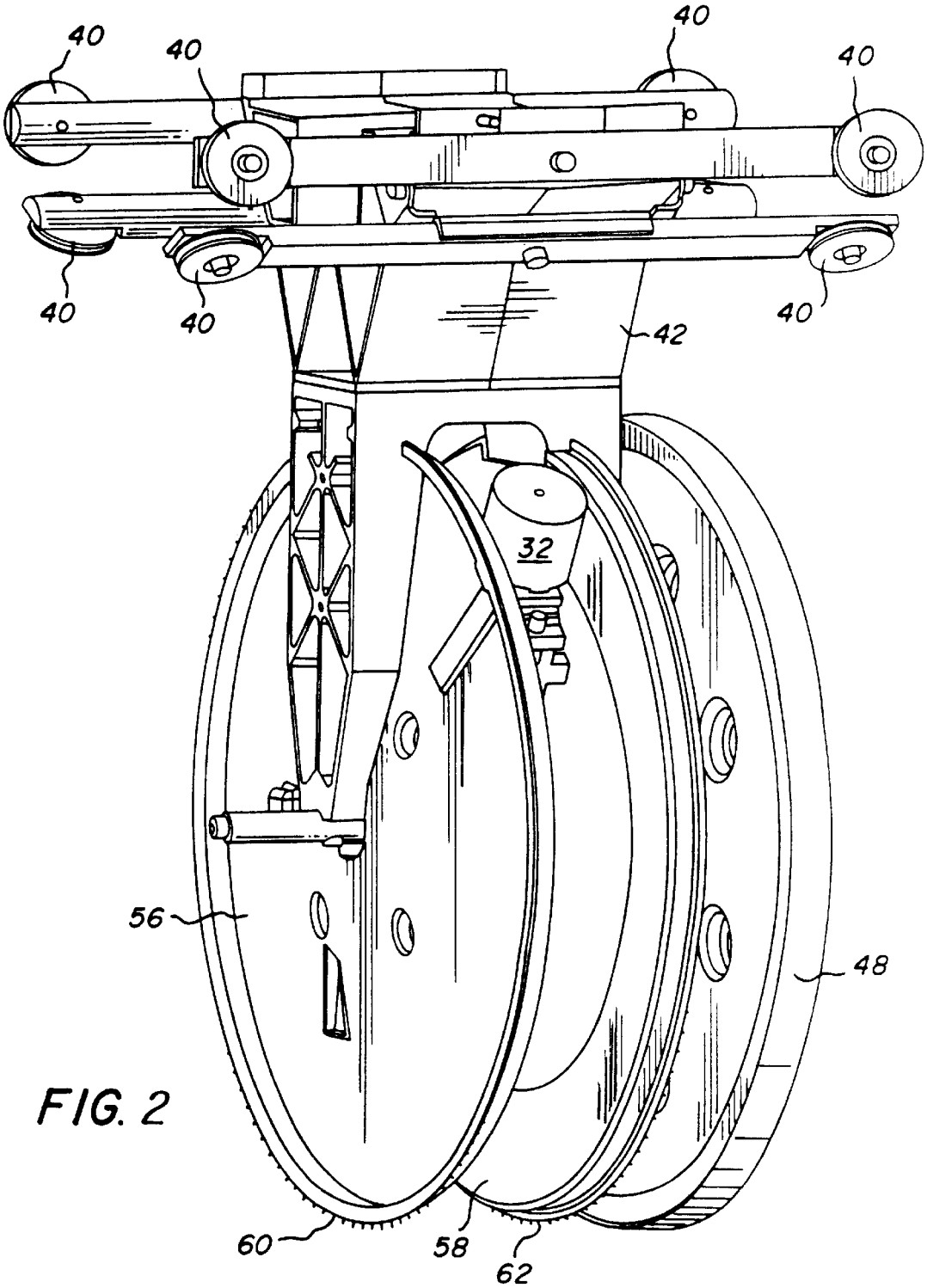
FIG. 2 is a perspective view of a portion of the printer of FIG. 1.

As may be best seen in FIG. 2, along with other features now to be mentioned, a plurality of wheels 40 are ratably attached to a carriage 42 which translates along guide rods 36 and 38 by means of a lead screw 44 turned by a lead screw stepper motor, not shown. See commonly assigned, co-pending U.S. patent application Ser. No. 08/123,838 entitled LEADSCREW COUPLER, filed in the names of Jadrich et al. on Sep. 20, 1993. The disclosure of the Jadrich et al. patent application is hereby specifically incorporated herein by reference. A rotor support member 46 is rigidly attached to carriage 42, and carries rotor 32. The rotor is simultaneously rotated by the drive motor in a fast scan direction and is translated past the cylindrical support in the slow scan direction (axially) by the stepper motor and lead screw 44, thereby achieving a raster scan pattern on photosensitive media 16 held within cylindrical support 26. Also attached to rotor support member 46 is a media guide disc 48 arranged such that a bridge space gap is created between the outer diameter of the media guide disc and the arcuate inner surface of cylindrical support 26. A fixed disc 56 and another disc 58 are positioned on opposed axial sides of rotor 32. Discs 56 and 58 are provided with anti-static brushes 60 and 62, respectively.

Figure 3:
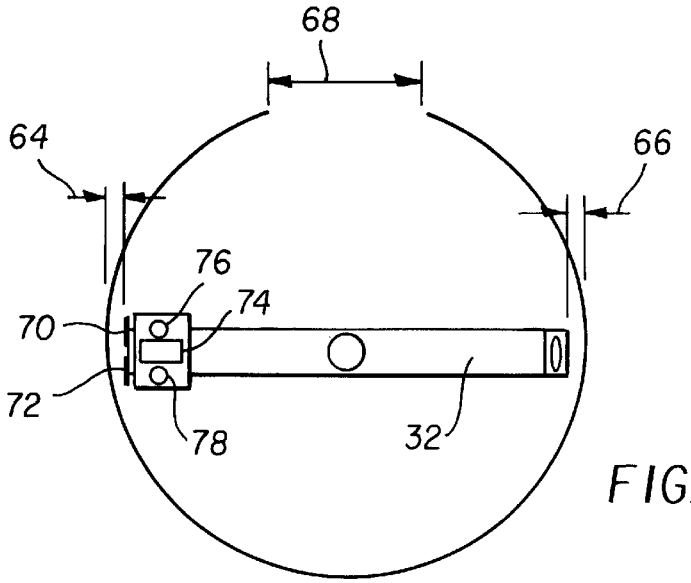
FIG. 3 is a front schematic view of a rotary printing system.

In FIG. 3, rotor 32 is schematically shown to leave a back gap 64 and an optics gap 66 between the ends of rotor 32 and media 16 on the inner surface of the cylindrical support. A bridge space 68 extends between the two ends of the cylindrical support. This space bridges an area through which media is loaded into cylindrical support 26, and through which exposed media is fed from the support.

A pair of electrodes 70 and 72 are affixed to the back gap end of rotor 32 in close proximity to cylindrical support 26. A signal processing electronics package 74, to be explained below, a red LED 76 and a green LED 78 are also carried on the back gap end of rotor 32. The LEDs are mounted so as to be visible from outside of cylindrical support 26 with little or no disassembly.

Figure 4:
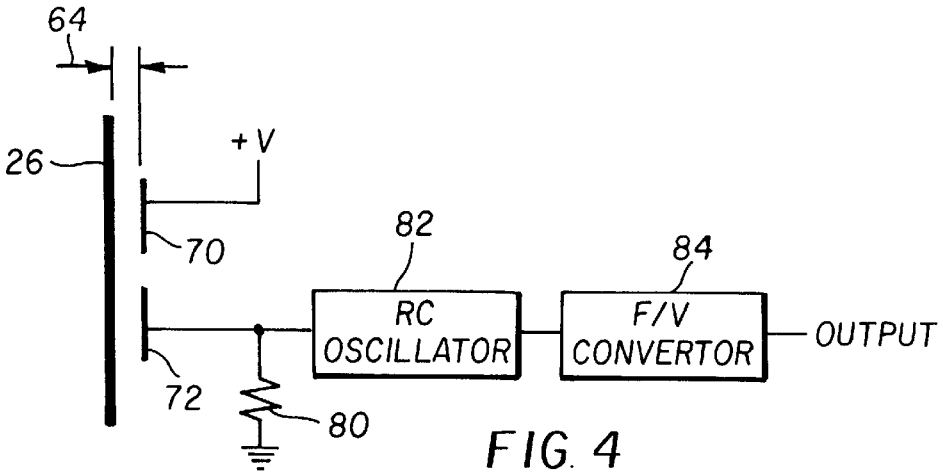
FIG. 4 is a block diagram of a circuit for sensing the gap between the rotor and the cylindrical support of the rotary printing system of FIGS. 1–3.

Electrodes 70 and 72 form capacitor plates with the wall of cylindrical support 26 such that the capacitance of the electrode-to-wall geometry is inversely proportional to the back gap dimension 66. Referring to FIG. 4, the dimension of the back gap can be measured by inclusion of this capacitance and a resistor 80 in the timing circuit of a resistor/capacitor (RC) oscillator 82 and conversion of the resulting gap-dependent frequency of the oscillator into a voltage using a frequency-to-voltage converter 84. Although the illustrated embodiment makes use of an RC oscillator, it will be understood that an inductor/capacitor (LC) oscillator implementation would work equally well.

Figure 5:
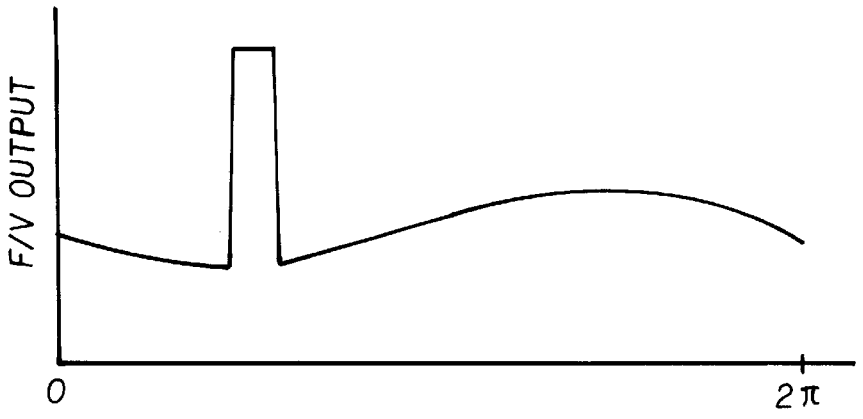
FIG. 5 is a graph of the frequency-to-voltage output of the circuit of FIG. 4.

FIG. 5 shows the frequency-to-voltage converter output over a single rotor revolution for a case of misaligned cylindrical support and rotor axes. Where electrodes 70 and 72 are radially aligned with the cylindrical support, voltage output of converter 84 tracks the back gap dimension, with a larger gap reflected as a higher voltage. The voltage is roughly sinusoidal, with phase determined by the direction of axis offset. In the region of bridge space 68, capacitance plunges to a minimum determined by stray effects, and the frequency-to-voltage converter output is driven to saturation.

When aligning the rotor and cylindrical support axes, the goal is to adjust the cylindrical support mounting hardware to minimize the sinusoidal component amplitude, and to therefore minimize the back gap variation. To this end, the sinusoidal component mean value is calculated and differenced with the frequency-to-voltage converter output. To calculate the sinusoidal component mean value, the effect of the voltage spike at bridge space 68 should be compensated for or eliminated. In the interval of bridge space 68, the period of RC oscillator 82 falls below some threshold value far removed from that observed over the cylindrical support. Comparing the pulse width of the output of frequency-to-voltage converter 84 with a fixed minimum on a pulse-to-pulse basis, when the pulse width falls below a predetermined threshold, one may deduce that the sensor is in the interval of bridge space 68. Likewise, when the pulse widths exceed the predetermined threshold, the sensor is aligned with the wall of the cylindrical support. The pulse width in the area of bridge space 68 is typically less than 10% of that over the minimum pulse width generated over the cylindrical support; making differentiation of the zones quite straightforward.

In FIG. 6, this effect is used to exclude contributions of bridge space 68 from a low pass filter calculation of frequency-to-voltage output average. The output of frequency-to-voltage converter 84 is selectively switched at 86 to a low pass filter 88 upon detection of bridge space 68 by bridge detector 90. The outputs of frequency-to-voltage converter 84 and low pass filter 88 are inputted to a differential amplifier 92, whose output is shown in FIG. 7. The differential amplifier output reflects the presence of the interval of bridge space 68 even though the low pass filter output does not. The amplifier output is biased to the sinusoidal mean and offset either positive to drive red LED 76 to its ON state, or negative to drive green LED 78 to its ON state. The amplitude of electrical current sourced or sunk through LEDs 76 and 78 is proportional to the excursion of the output of converter 84 from the sinusoidal mean value. The gain of the difference, and therefore the brightness of the LEDs, is set by an input resistor 94 of differential amplifier 92. Normally, the red LED would be full ON in the region of bridge space 68. Preferable, the LEDs are blanked in the region of bridge space 68 by means of bridge detect circuit 90 closing a shunting switch 96 across the LEDs in the region of bridge space 68 at the same time that the bridge detect circuit disconnects low pass filter 88. The relationship between the output of converter 84 and the illumination of the LEDs is illustrated in FIG. 7.

Figure 8:
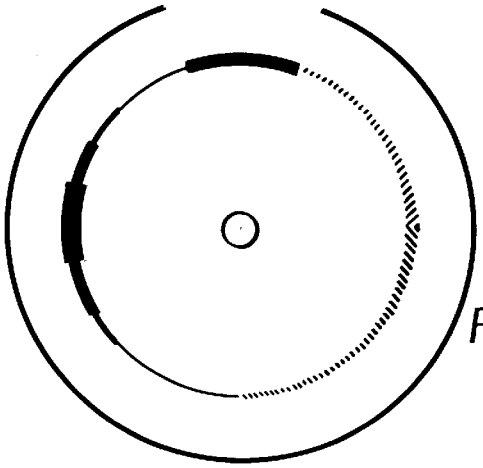
FIG. 8 is a schematic illustration of the output of the LED during operation.

Red and green LEDs 76 and 78 are positioned so as to be visible in an axial view of rotor 32. In regions of smaller than average back gap, the capacitance of electrodes 70 and 72 will be larger, the frequency of oscillator 82 will be smaller, and red LED 76 will be illuminated. In regions of larger than average back gap, the capacitance of electrodes 70 and 72 will be smaller, the frequency of oscillator 82 will be larger, and green LED 78 will be illuminated. The light patterns that a user would see with the LEDs active and the rotor axis misaligned to the right of true position is illustrated in FIG. 8. The width of the arcs in the drawing is intended to convey LED brightness to the reader, and the arc patterns is intended to convey color. The pattern is stationary for any given alignment setting.

The adjustment procedure for the position of cylindrical support 26 will then be to simply iteratively adjust the support's alignment screws so as to minimize the light output of the two LEDs. The direction and amplitude of adjustment are apparent from the color and intensities of the LEDs.

Figure 9:
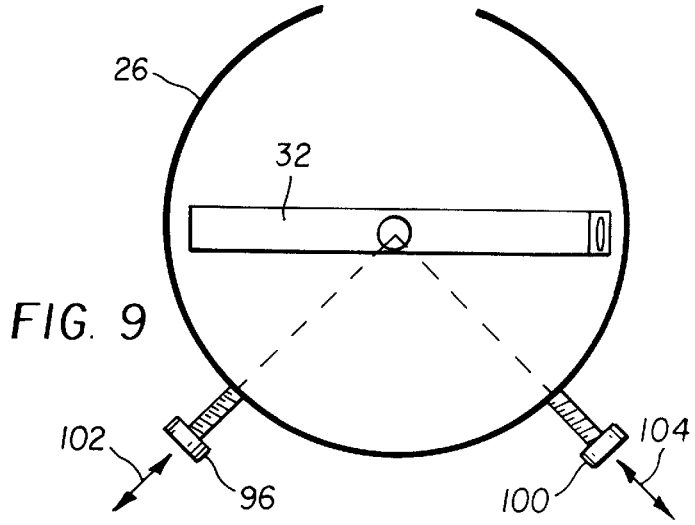
FIG. 9 is a schematic illustration of an alignment mechanism for the rotary printing system.
Figure 10:
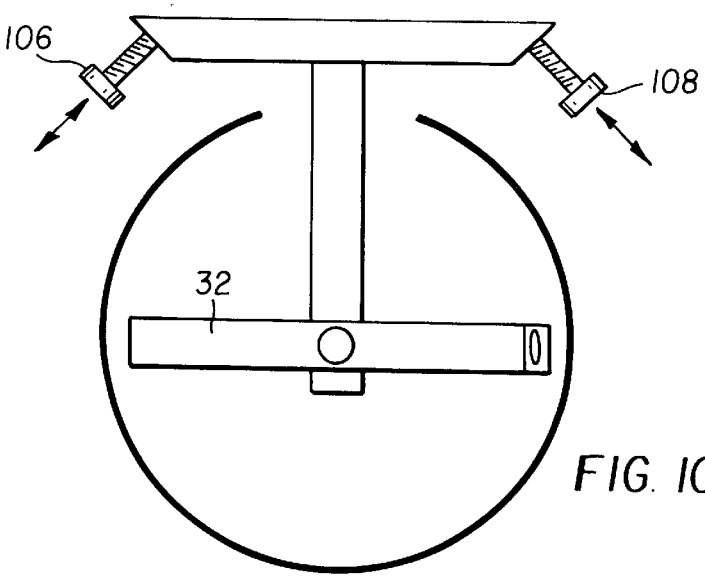
FIG. 10 is a schematic illustration of another alignment mechanism for the rotary printing system.

The relative adjustment of rotor 32 and cylindrical support 26 to achieve coaxial alignment can be accomplished in either of two ways as shown in FIGS. 9 and 10, respectively. In FIG. 9, the rotor axis is considered to be fixed, the cylindrical support is translated. A typical adjustment geometry using a pair of jackscrews 98 and 100 is shown in which the respective translational axes 102 and 104 are orthogonal so as to de-couple the two degrees of adjustment freedom. In FIG. 10, the axis of the cylindrical support is considered to be fixed, and the translator axis is adjusted through the use of orthogonally oriented jackscrews 106 and 108.

The invention has been described in detail with particular reference to preferred embodiments thereof, but it will be understood that variations and modifications can be effected within the spirit and scope of the invention.

What is claimed is:

1. An imaging apparatus having a concentric support with an at-least-partially cylindrical inner surface for receiving a recording media about an axis of the support, a rotor which is rotatable about an axis, a portion of the rotor and the inner surface of the support forming a gap such that a dimension of the gap changes as the rotor rotates and as an inverse function of the concentricity of the support and the rotor, a write head assembly carried by the rotor to write on recording media received on the at least partially cylindrical inner surface of the support, said imaging apparatus further comprising:

adjustment apparatus for translating at least one of the support and the rotor to co-align the support axis and the rotor axis;

apparatus for measuring the concentricity of the support and the rotor while the rotor is rotating, said apparatus for measuring comprising:

a first electrode carried at the portion of the rotor forming the gap with the inner surface such that a capacitance between the electrode and the inner surface varies as the rotor rotates and as an inverse function of the concentricity of the support and the rotor; and a detector, including a power source adapted to produce an electrical charge across the gap and an impedance, for measuring a change in the dimension of the gap as the rotor rotates.

2. An imaging apparatus as set forth in claim 1 wherein the capacitance and the impedance of the detector are included in a timing circuit of an oscillator that produces an output signal having a frequency that is a function of the concentricity of the support and the rotor.

3. An imaging apparatus as set forth in claim 2 further comprising a frequency-to-voltage converter that produces an output signal having an amplitude that is a function of the concentricity of the support and the rotor.

4. An imaging apparatus as set forth in claim 1 wherein the capacitance and the impedance of the detector are included in a timing circuit of an oscillator.

5. An imaging apparatus as set forth in claim 1 the rotor is simultaneously rotatable about and linearly translatable along the axis of the rotor.

6. An imaging apparatus as set forth in claim 1 wherein a second electrode is carried at a portion of the rotor forming the gap with the inner surface, the second electrode being closely spaced from the first electrode.

7. An imaging apparatus as set forth in claim 1 wherein the adjustment apparatus includes adjustment apparatus adapted to translate at least one of the support and the rotor to co-align the support axis and the rotor axis.

8. An imaging apparatus as set forth in claim 1 wherein:

said electrical charge across the gap changes with changes in the dimension of the gap; and said measuring apparatus further comprises means for optically indicating the concentricity of the support and the rotor while the rotor is rotating.

9. An imaging apparatus as set forth in claim 8 wherein said indicating means includes an oscillator adapted to convert a change in the electrical charge across the gap to a change in a frequency output.

10. An imaging apparatus as set forth in claim 9 wherein said indicating means further includes a frequency to voltage converter to change the frequency output of the oscillator to a change in voltage output, the voltage output having a magnitude and sign; and optical means for producing a visual display of the magnitude and sign of the voltage output of the converter.

* * * * *

UNITED STATES PATENT AND TRADEMARK OFFICE

CERTIFICATE OF CORRECTION

PATENT NO. : 5,844,589
DATED : December 1, 1998
INVENTOR(S) : David M. Orlicki, et al It is certified that error appears in the above-indentified patent and that said Letters Patent is hereby corrected as shown below:

| | |
|---|---|
| Column 5, line 24 | before "inner" insert -- at least partially cylindrical-- |
| Column 5, line 31 | delete the comma "," and insert a semi-colon ";" |

Signed and Sealed this

Sixteenth Day of November, 1999

*Attest:*

Q. TODD DICKINSON

*Attesting Officer*

*Acting Commissioner of Patents and Trademarks*